US005319610A

United States Patent [19]

Airhart

[11] Patent Number: 5,319,610

[45] Date of Patent: Jun. 7, 1994

[54] HYDRAULIC ACOUSTIC WAVE GENERATOR SYSTEM FOR DRILLSTRINGS

[75] Inventor: Tom P. Airhart, Plano, Tex.

[73] Assignee: Atlantic Richfield Company, Los Angeles, Calif.

[21] Appl. No.: 674,821

[22] Filed: Mar. 22, 1991

[51] Int. Cl.[5] ..... G01V 1/40

[52] U.S. Cl. ..... 367/82; 367/143; 367/912; 181/106; 175/1

[58] Field of Search ..... 367/82, 143, 912; 181/106; 381/163; 175/1

[56] References Cited

U.S. PATENT DOCUMENTS

| | | | |
|---|---|---|---|
| 3,252,225 | 5/1966 | Hixson | 367/82 |
| 3,929,206 | 12/1975 | Bedenbender et al. | 181/114 |
| 4,139,836 | 2/1979 | Chaney et al. | 367/82 |
| 4,283,780 | 8/1981 | Nardi | 367/82 |
| 4,293,937 | 10/1981 | Sharp et al. | 367/82 |
| 4,314,365 | 2/1982 | Petersen et al. | 175/56 |
| 4,347,900 | 9/1982 | Barrington | 367/82 |
| 4,375,239 | 3/1983 | Barrington et al. | 367/82 |
| 4,805,727 | 2/1989 | Hardee et al. | 181/106 |
| 5,031,717 | 7/1991 | Hardee et al. | 181/106 |
| 5,137,109 | 8/1992 | Dorel | 181/106 |
| 5,159,226 | 10/1992 | Montgomery | 310/333 |

OTHER PUBLICATIONS

Barnes et al., Journal of the Acoustical Society of America vol. 51, #5 (Part 2), pp. 1606-1608, 1972.

*Primary Examiner*—Nelson Moskowitz
*Attorney, Agent, or Firm*—Michael E. Martin

[57] ABSTRACT

An acoustic wave generator for telemetering signals through a drillstem comprises a sub interposed in the drillstem with a central mandrel and a piston mass disposed in sleeved relationship around the mandrel and reciprocable by hydraulic pressure fluid to impose reaction forces on the mandrel and the drillstring at selected frequencies to transmit acoustic waves through the drillstring. A control system for operating the generator includes a hydraulic pump, a control valve and a frequency control circuit which operates the control valve to effect reciprocation of the piston mass at selected frequencies for transmitting serial data from the control system through the drillstring to a receiving system. The generator is coaxially arranged in the drillstring and is operable to generate high-energy acoustic wave signals for propagation through relatively long drillstrings.

4 Claims, 2 Drawing Sheets

HYDRAULIC ACOUSTIC WAVE GENERATOR SYSTEM FOR DRILLSTRINGS

BACKGROUND OF THE INVENTION

1. Field of the Invention

This invention relates to a hydraulic actuator and control system for generating and transmitting acoustic vibration signals through a drillstem from a downhole location to a surface receiver system.

2. Background

The desire to obtain data pertaining to downhole operating conditions when drilling and completing oil and gas wells has spawned the development of several types of systems for transmitting information through the wellbore or the drillstring to a surface receiving and recording system. One promising approach to transmitting signals from downhole measurement devices to the surface comprises generating mechanical vibrations or so-called acoustic waves which are transmitted through the drillstem to a surface receiving system connected to the drillstem. Acoustic wave generators or transmitters are particularly attractive in view of the development of surface disposed receiving systems of the type disclosed in U.S. Pat. No. 4,715,451 to Bseisu, et al., and assigned to the assignee of the present invention. The system disclosed in the Bseisu, et al., patent is adapted to receive and transmit to a suitable display or recorder acoustic waves generated in axial, torsional and bending modes of the drillstem. Accordingly, if a suitable transducer or generator can be disposed downhole, then certain measurement parameters such as pressure and temperature conditions can be converted to vibrational signals which are transmitted through the drillstem for receipt by a system such as disclosed in the patent reference.

One system, generally of the type described above, is disclosed in U.S. patent application Ser. No. 07/554/022, filed Jul. 16, 1990 in the name of Melvin G. Montgomery and also assigned to the assignee of the present invention. Another type of transmitter system is described in U.S. Pat. No. 4,992,997 to Bseisu and assigned to the assignee of the present invention.

One shortcoming of some prior art systems is that the energy input to the drillpipe or tubing by the transducer or generator, particularly in long drillstems or tubing strings, may not be sufficient to obtain signals at the surface which are coherent due to transmission losses in the pipe or tubing. The present invention seeks to overcome this problem by providing a variable frequency, hydraulically actuated acoustic wave generator and associated control system for transmitting acoustic signals through drillstems, tubing strings and the like.

SUMMARY OF THE INVENTION

The present invention provides an improved acoustic wave generator system for transmitting acoustic wave signals through a drillstem and the like.

In accordance with one aspect of the present invention, a hydraulic acoustic wave generator is provided in conjunction with a control system for generating acoustic waves or mechanical vibrations for transmission through a drillstem or similar tubing string disposed in a wellbore for transmitting wellbore information to the surface.

In accordance with another important aspect of the present invention, a hydraulic reciprocating mass type stress wave or acoustic wave generator is provided interposed in a drillstring or tubing string downhole for converting suitable electrical signals to so-called stress or acoustic wave type signals for transmission through the drillstring to the surface. The wave generator includes a concentric reciprocating mass which is reciprocated at selected frequencies to induce mechanical stress or "acoustic" vibrations in the drillstring which are transmitted to the surface. The intensity or amplitude of the acoustic waves is enhanced by the particular type of generator of the present invention to minimize signal degradation at the surface due to transmission losses.

Those skilled in the art will recognize the above-described features and advantages of the present invention, together with other superior aspects thereof upon reading the detailed description which following in conjunction with the drawing.

DESCRIPTION OF A PREFERRED EMBODIMENT

Figure 1:
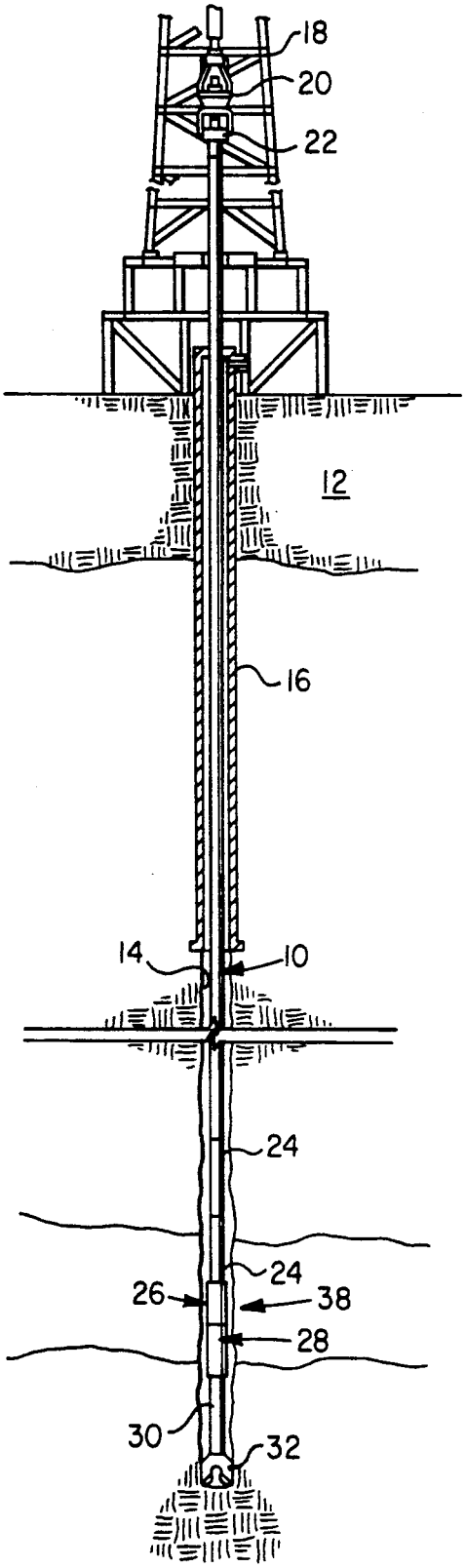
FIG. 1 is a schematic diagram of a drillstring, including the stress or acoustic wave signal generating and transmitting system of the present invention.

In the description which follows, like parts are marked throughout the specification and drawing with the same reference numerals, respectively. The drawing figures are not necessarily to scale, and several components are shown in schematic or block diagram form in the interest of clarity and conciseness.

Referring to FIG. 1, there is illustrated, in somewhat schematic form, a drillstring 10 penetrating an earth formation 12 to form a wellbore 14 which includes, at least partially throughout its length, a casing 16. A conventional drilling rig 18 supports the drillstring 10 for drilling operations or the like. The drillstring 10 is suspended from the drill rig 18 by a conventional swivel 20. The swivel 20 is connected to a sub 22 at the upper end of the drillstring 10, which includes suitable transducers, a frequency shift key (FSK) demodulator and receiver and a sending unit, all to be described in further detail herein. The arrangement of transducers may be similar to that described in U.S. Pat. No. 4,715,451. Such transducers are operable to receive axial, mechanical compression waves transmitted along the drillstring 10. The drillstring 10 is made up of a plurality of interconnected pipe or tube members 24, one of which is connected to a sub 26, which includes an acoustic wave or so-called stress wave generator which will be described in further detail herein, particularly in conjunction with FIG. 2. The sub 26 is, in turn, connected to a second sub 28 which includes suitable controls for effecting the inducement of mechanical axial vibrations or acoustic waves into the drillstring 10 for transmission to the sub 22. The drillstring 10 further includes a conventional drill collar 30 which may be modified to include certain sensors thereon, such as pressure and temperature sensors, not shown, and a conventional drill bit. In drilling or performing other operations in the drillbore 14, it is often desirable to know pressure, temperature or other formation conditions as experienced by the bit 32 during drilling of the wellbore, for example. Accordingly, certain sensors may also be placed on or adjacent to the bit 32 which are operable to generate electrical signals indicating the conditions in the wellbore desired to be known. These signals are then converted to suitable vibrations for transmission along the drillstring to be received by the transducers on the sub 22.

U.S. Pat. No. 4,314,365 to Petersen, et al., describes a system for transmitting acoustic waves along a drillstring from the surface to some point on the drillstring in the wellbore for operation of certain wellbore or downhole equipment. In the Petersen patent, a portable electro-hydraulic transmitter is releasably connected to the upper end of the drillstring to generate longitudinal acoustic vibrations in the drillstring. The device described in the Petersen patent is relatively large, cumbersome and not suitable for deployment in or as part of the drillstring in the wellbore. Although the piezoelectric type transmitter or generator described in the above-referenced patent application, Ser. No. 554,022, has certain advantages, in relatively long drillstrings the energy imparted by the transmitter may not be sufficient to generate perceptible signals at the surface. To this end, the acoustic wave generator described hereinbelow and illustrated in FIG. 2 holds certain advantages.

Figure 2:
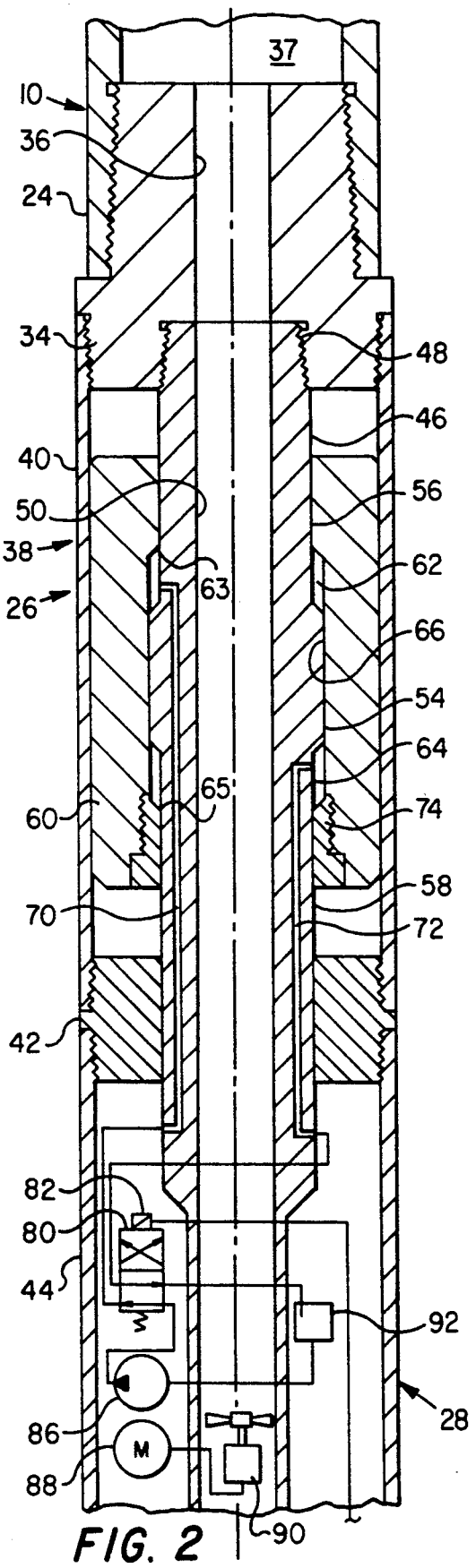
FIG. 2 is a detail central longitudinal section view of the acoustic wave generator.

Referring to FIG. 2, the sub 26 is suitably connected to one of the drillstring members 24 of the drillstring 10 by way of a threaded coupling 34 having a central longitudinal passage 36 formed therein and in communication with a central longitudinal passage 37 of the drillstring 10. The sub 26 comprises a hydraulic acoustic wave generator, generally designated by the numeral 38, and further comprising a generally tubular outer housing member 40 threadedly connected to the coupling member 34 and to a coupling member 42. The coupling member 42 is also threadedly connected to a tubular member 44 comprising part of the sub 28.

An elongated cylindrical mandrel 46 is threadedly connected at 48 to the coupling member 34 and extends coaxially within the tube 40 of the sub 26, through the coupling 42 and into the interior of the tube 44 of the sub 28. The mandrel 46 includes a central longitudinal passage 50 formed therein and in communication with the passage 36. The mandrel 46 also includes a radially, outwardly projecting collar portion 54 which is interposed between a cylindrical portion 56 and a cylindrical portion 58 which extends through the coupling 42. The diameter of the collar portion 54 is greater than the diameter of the mandrel portions 56 and 58. A reciprocable piston mass member 60 is slidably disposed in the tube 40 and in close fitting proximity to the collar portion 54 to define opposed expansible fluid chambers 62 and 64 between the bore 66 of the piston 60 and the mandrel portions 56 and 58. Elongated fluid-conducting passages 70 and 72 are formed in the mandrel 46 and open into the chambers 62 and 64, respectively. The lower end of the piston 60, viewing FIG. 2, is provided with a removable threaded nut 74 which closes one end of the passage 64 to facilitate assembly and disassembly of the piston with respect to the mandrel 46.

Pressure fluid, such as hydraulic fluid, is introduced into the chambers 62 and 64 to effect reciprocal movement of the piston 60 with respect to the mandrel 46 in a manner controlled by a distributing valve 80 disposed in the sub 28, as indicated schematically in FIG. 2. The valve 80 is adapted to be actuated by a solenoid actuator 82, for example, to rapidly move between positions a and b which will effect, alternately, pressurizing and venting of the respective chambers 62 and 64 to effect rapid reciprocable movement of the piston 60 with respect to the mandrel 46. The travel of the piston 60 is limited by movement of the piston toward to the collar 54 wherein the volumes of the chambers 62 and 64 are alternately reduced and, as control edges 63 and 65 of the piston move past the passages 70 and 72, a small volume of fluid is trapped in the chambers 62 or 64 to arrest further movement of the piston and prevent impact of the piston with the collar 54. When this dashpot effect is encountered by the piston 60, its movement in the direction to decrease the volume of the respective chambers 62 and 64 is halted and before the piston impacts either the coupling 34 or the coupling 42.

Rapid reciprocation of the piston 60 at selected frequencies will impart substantial acoustic or stress wave type vibrations to the drillstring 10 at selected frequencies as determined by shifting the valve 80 between its positions a and b, indicated in FIG. 2. Accordingly, by suitably controlling movement of the valve 80, the frequency of reciprocation of the piston 60 may also be selectively controlled.

As shown schematically in FIG. 2, the sub 28 includes a suitable source of pressure fluid for effecting reciprocation of the piston 60, including a pump 86 driven by an electric motor 88. The motor 88 may be suitably connected to a source of electrical power which may comprise a turbine-driven generator 90 interposed in the sub 28 in such a way as to receive pressure fluid being conducted through the passages 36 and 50. Such fluid may be drilling mud or other fluid being used in conducting certain wellbore operations. The sub 28 typically also includes a suitable hydraulic fluid reservoir 92 to receive fluid vented from the chambers 62 and 64 through the valve 80.

Figure 3:
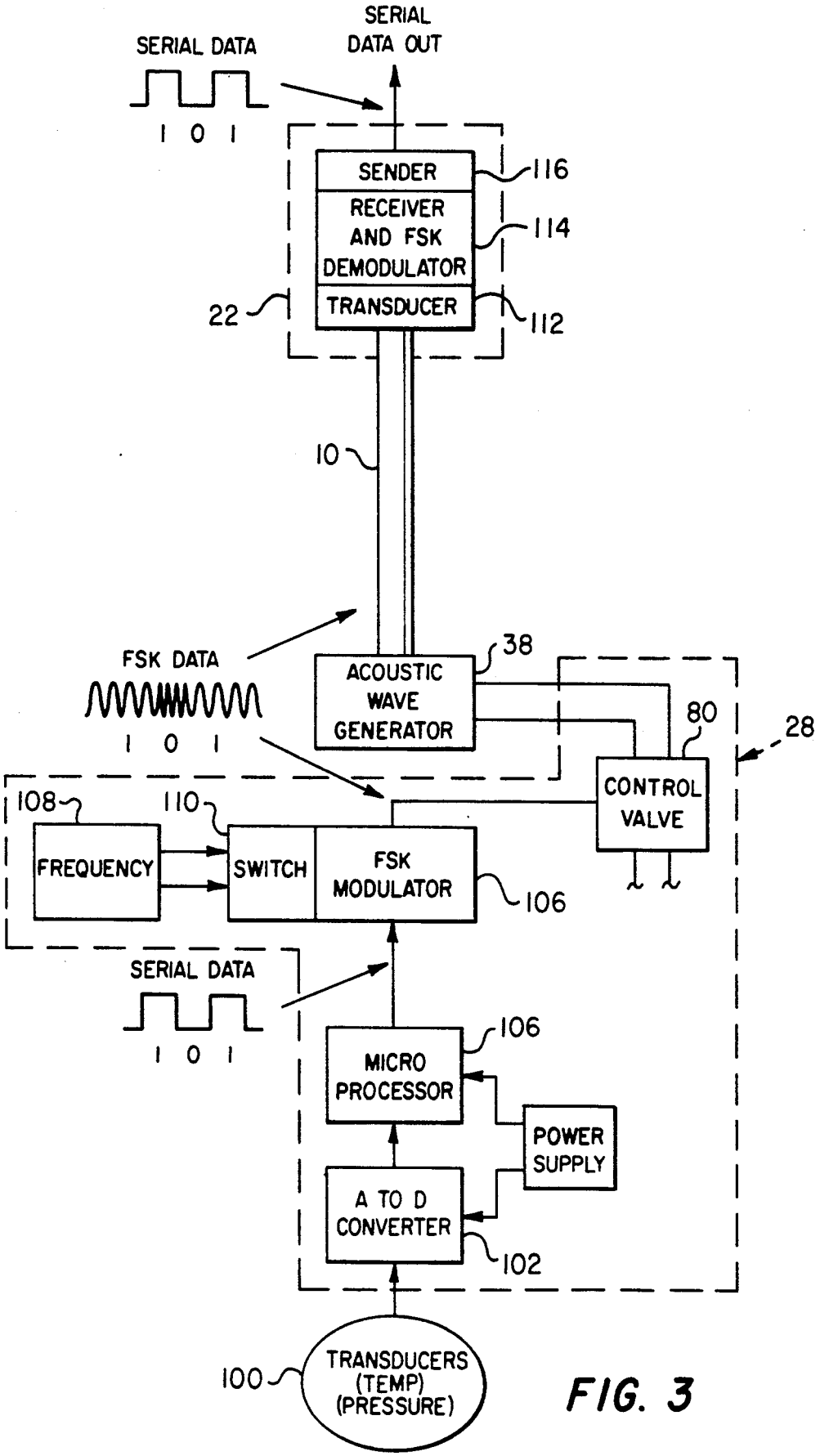
FIG. 3 is a function schematic diagram of the system of the present invention.

Referring now to FIG. 3, the system of the present invention is illustrated in a functional block diagram form, together with illustrations of its basic operation. FIG. 3 shows transducers 100 which may be disposed in the drill collar 30 or the bit 32 for measuring certain wellbore conditions such as temperature and pressure. The transducers 100 provide an analog signal to digital converter 102 disposed in the sub 28. The output of the A to D converter 102 is connected to a microprocessor 104 which may be of a type manufactured by Zylog as their model Z-8. Other general or special purpose type microprocessors may be used in place of the microprocessor 104. The microprocessor 104 interprets the digital value of the detected physical signal and applies it as a serial digital data stream to a conventional frequency shift key modulator 106. As is well-known in the art, frequency shift keying is a type of modulation which provides a signal at a first frequency to represent a digital "zero" and at a second frequency to represent a digital "numeral one". In the example of FIG. 3, a frequency control circuit 108 is connected to the frequency shift key (FSK) modulator 106 and is operable to provide sinusoidal signals at two frequencies which are generally close together but distinguishable by a demodulator circuit. Switch 110 and FSK modulator 106 apply to control valve 80 one of the two frequency signals output by the circuit 108 based on the serial digital data presented by the microprocessor 106. Cyclical operation of the valve 80 effects operation of the generator 38 to generate an acoustic wave or vibration which is transmitted through the drillstring 10 and which corresponds to the frequency shift keyed data received from the FSK modulator 106.

The vibrations induced into the drillstring 10 are sensed by a transducer 112 disposed on the sub 22. The transducer 112 can be a piezoelectric type, an accelerometer, a strain gauge or other conventional transducer for generating an electrical signal in response to physical forces applied thereto. An electrical signal output from transducer 112 is received by a receiver and frequency shift key (FSK) demodulator 114, such as a model XR-2211 demodulator/tone decoder manufactured and sold by Exar or another conventional FSK demodulator/tone decoder circuit. The output of demodulator 114 is a digital signal, for example, a serial data stream, which is communicated to a sender unit 116. Accordingly, there is a serial data output from the sender 116 which may be transmitted to a computer or other data processing unit, not shown, for analysis of the received vibrational data to determine the characteristics of the signals developed by the transducers 100.

While frequency shift keying is discussed hereinabove, other data encoding techniques, including a simple, repetitive frequency or amplitude or frequency modulation technique could be used. For example, phase shift keying or modifications thereof could be employed to transmit data along the drillstring 10. Examples of alternate prior methods for frequency shift keying an electrical signal are described in U.S. Pat. No. 4,156,229, and an alternate prior art method for phase shift keying an electrical signal is described in U.S. Pat. No. 4,562,559.

Using the generator 38 and the technique discussed herein, many systems can be provided to transmit large amounts of information quickly from a wellbore to a surface location, or vice versa. By selection and modification of frequency control circuit 108 under local control, or by signals transmitted from a remote device, different transmission frequencies can be achieved and the frequency can be adjusted for optimum transmission along the drillstring. In addition, multiple generators 38 could be placed along the drillstring, each operating at a different frequency, or a set of frequencies, to avoid interference with each other. Also, a sweep of the transmission frequency may be used to determine the frequency response of the drillstring 10, which itself may include important data concerning the characteristics of the drillstring and its operation.

Operation of the system of the present invention is believed to be readily understandable from the foregoing description. Conventional materials and engineering techniques may be utilized in developing and providing the subs 26, 28 and the components disposed therein, including the generator 38 and the control circuit or system described and shown schematically in FIG. 3. Electrical power for operating the motor 88 and the other electrical devices in the sub 28 may be provided from a suitable source, including the generator 90, or a stored source of electrical power such as a battery, not shown. Thanks to the arrangement of the generator 38, which includes a reciprocating piston or mass 60 which does not impact the mandrel 46 or the couplings 42 and 34 forming end portions of the sub, acoustical or stress type vibrations can be introduced into a drillstring or tubing string and are of sufficient energy to be transmitted through relatively long drillstrings to a receiving unit such as that arranged on the sub 22 at the surface.

Although a preferred embodiment of the present invention has been described in detail herein, those skilled in the art will recognize that various substitutions may be made to the system and the generator 38 without departing from the scope and spirit of the invention as recited in the appended claims.

What is claimed is:

1. A system for imparting controllable vibrations to one of an elongated drillstring and tubing string, said system comprising:

a sub connected to said drillstring and including a hollow mandrel extending within a bore formed in said sub;

a reciprocable piston mass disposed in said bore and in sleeved relationship over said mandrel and cooperable therewith to impart reaction forces to said sub, said piston mass, said sub and said mandrel defining opposed expansible fluid chambers for receiving pressure fluid;

a source of pressure fluid including hydraulic pump means and control valve means for delivering hydraulic fluid under pressure to said chambers, respectively, to effect reciprocation of said piston mass to impart vibrations to said drillstring; and control means for delivering signals at not less than two frequencies to said control valve means to effect reciprocation of said piston mass at said frequencies.

2. The system set forth in claim 1 wherein:

said pump means and said control valve means are disposed in said drillstring.

3. A system for transmitting acoustic signals at selected frequencies through a tubing string comprising:

an elongated sub adapted to be supported in said tubing string, said sub including opposed end parts, 9 generally cylindrical tubular member interconnecting said end parts, a reciprocable piston mass disposed in said tubular member and a mandrel extending through said tubular member between said end parts, said piston mass being disposed in sleeved relationship over said mandrel and defining with said mandrel opposed expansible fluid chambers for receiving pressure fluid to effect reciprocation of said piston mass; and control means for delivering pressure fluid to said chambers in such a way as to effect reciprocation of said piston mass at selected frequencies for transmitting acoustic wave signals along said tubing string to a receiver.

4. The system set forth in claim 3 including:

transducer means in said tubing string for transmitting signals related to a condition sensed by said transducer means;

an A to D converter for converting transducer signals to digital signals;

a frequency control circuit for converting digital signals to signals of selected frequencies; and control means for effecting reciprocation of said piston mass at selected frequencies corresponding to said digital signals to provide acoustic wave signals in said tubing string;

receiver means connected to said tubing string for receiving said acoustic wave signals and converting said signals to a serial data stream.

* * * * *